US005330185A

United States Patent [19]

Wells

[11] Patent Number: 5,330,185

[45] Date of Patent: Jul. 19, 1994

[54] METHOD AND APPARATUS FOR RANDOM PLAY OF LOTTERY GAMES

[75] Inventor: L. Rogers Wells, Versailles, Ky.

[73] Assignee: Interlott, Inc., Cincinnati, Ohio

[21] Appl. No.: 39,751

[22] Filed: Mar. 30, 1993

[51] Int. Cl.[5] ..... A63F 9/00

[52] U.S. Cl. ..... 273/138 A; 273/138 R; 273/139; 273/143 R; 364/412

[58] Field of Search ..... 273/138 A, 138 R, 139, 273/143 R; 364/412; 902/22, 23; 235/275, 281; 283/903

[56] References Cited

U.S. PATENT DOCUMENTS

| | | | |
|---|---|---|---|
| 4,157,829 | 6/1979 | Goldman et al. | 273/138 A |
| 4,494,197 | 1/1985 | Troy et al. | 364/412 |
| 4,689,742 | 8/1987 | Troy et al. | 364/412 |
| 4,692,863 | 9/1987 | Moosz | 364/412 |
| 4,713,787 | 12/1987 | Rapp | 364/717 |
| 4,817,951 | 4/1989 | Crouch et al. | 273/143 R |
| 4,833,307 | 5/1989 | Gonzales-Justiz | 235/375 |
| 4,842,278 | 6/1989 | Markowicz | 273/138 A |
| 4,858,122 | 8/1989 | Kreisner | 364/410 |
| 4,982,337 | 1/1991 | Burr et al. | 364/479 |
| 5,085,435 | 2/1992 | Rossides | 273/138 A |
| 5,110,129 | 5/1992 | Alvarez | 273/138 A |
| 5,186,463 | 2/1993 | Marin et al. | 273/138 R |
| 5,223,698 | 6/1993 | Kapur | 235/375 |

OTHER PUBLICATIONS

Interlott, Inc. "Instant Success", Oct. 1992, All pages, first disclosed Apr. 1992.

*Primary Examiner*—Jessica J. Harrison
*Assistant Examiner*—Kerry Owens
*Attorney, Agent, or Firm*—Jon L. Roberts; Thomas M. Champagne

[57] ABSTRACT

A lottery game card vending machine on which multiple games are available for play. The user can select any specific game desired. If an additional element of chance is desired by the player, the player can select a random selection function whereby a processing means comprising a random number generator adapted to the number of games available on the lottery machine is initialized upon actuation of a switch by the player. When the player actuates the random game selection switch the processing means randomly selects a lottery game/card to be played based upon the random number generated at the time the select button is actuated. The visual indicia will also light one at a time in a sequence, eventually stopping such that the indicia of the game selected by the random number generator is illuminated. The indicia may be lights or light emitting diodes (LEDS), for example, used to indicate the different games.

20 Claims, 3 Drawing Sheets

METHOD AND APPARATUS FOR RANDOM PLAY OF LOTTERY GAMES

FIELD OF THE INVENTION

The present invention relates generally to a method and apparatus for generating a random selection of a lottery game to be played in lottery machines with multiple lottery games. More particularly the invention allows a user to select a random play button to allow the random play of any one of a number of games as opposed to the user selecting a specific game to be played.

BACKGROUND OF THE INVENTION

Lottery games and other games of chance are well known in the United States and abroad. Such games afford states and municipalities an opportunity to raise substantial sums of money without raising taxes. As such they have become an integral part of governmental funding.

Many different types of chance games exist. These games fall into essentially two types: instant ticket games where a player scratches a film off the surface of a lottery card to reveal if the player is a winner and those lottery games where a random number is generated or a specific number is selected by an individual and compared to a number that is subsequently randomly generated at a central office.

The generation of random numbers in lotteries has been the subject of various patents. For example, U.S. Pat. No. 4,858,122 to Kreisner describes a random lottery computer. This computer has a random number generation system in it to generate any number of randomly selected numbers. These numbers are then compared to a centrally selected number to determine whether a player has won the specific lottery.

U.S. Pat. No. 4,692,863 to Moosz describes a random number generation apparatus for a lottery game. Again the results of this random number generation are numbers which win a particular lottery.

Other systems have been the subject of patents for the overall lottery system itself. For example, U.S. Pat. Nos. 4,689,742 4,494,197 to Troy et al. describes a wagering system having a central processor and various playing consoles which are remote from the central processor. U.S. Pat. No. 4,817,951 to Crouch et al. describes a player operable lottery machine which displays game results.

With the proliferation of numerous chance games including a large number of instant ticket games a market has evolved for lottery machines on which a player can play any number and different chance games to obtain any number of instant tickets relating to different types of lotteries. However, while the numbers played on the lottery tickets themselves may be randomly generated, in current lottery systems the user must specifically select the game to be played. It is therefore an enhancement of existing lottery machine vending technology to provide yet another element of randomness or "chance" relating to the selection of the game to be played itself.

SUMMARY OF THE INVENTION

It is an object of the present invention to provide a chance game vending machine which randomly selects a game to be played from a number of games available on the machine.

It is a further objective of the present invention to provide the option for a player to randomly select a chance game or to specifically select a desired game.

It is a further objective of the present invention to provide a system which provides an additional attraction to a player by virtue of randomly illuminating visual indicia of the games to be played until such time as a random selection is made.

The present invention comprises a lottery game card vending machine on which multiple games are available for play. The user can select any specific game desired. However, if an additional element of chance is desired by the player, the player can select a random selection function whereby a processing means comprising a random number generator adapted to the number of games available on the lottery machine is initialized upon actuation of a switch by the player. When the player actuates the random game selection switch the processing means randomly selects a lottery game/card to be played based upon the random number generated at the time the select button is actuated. In this fashion an additional element of chance is inserted into the lottery gaming process. As an additional feature of the random play capability, the visual indicia will light one at a time in a sequence, eventually stopping such that the indicia of the game selected by the random number generator is illuminated. The indicia may be lights or light emitting diodes (LEDS), for example, used to indicate the different games. In the preferred embodiment, the buttons used to select the individual games light up as a visual indicia of game selection.

DETAILED DESCRIPTION

Figure 1:
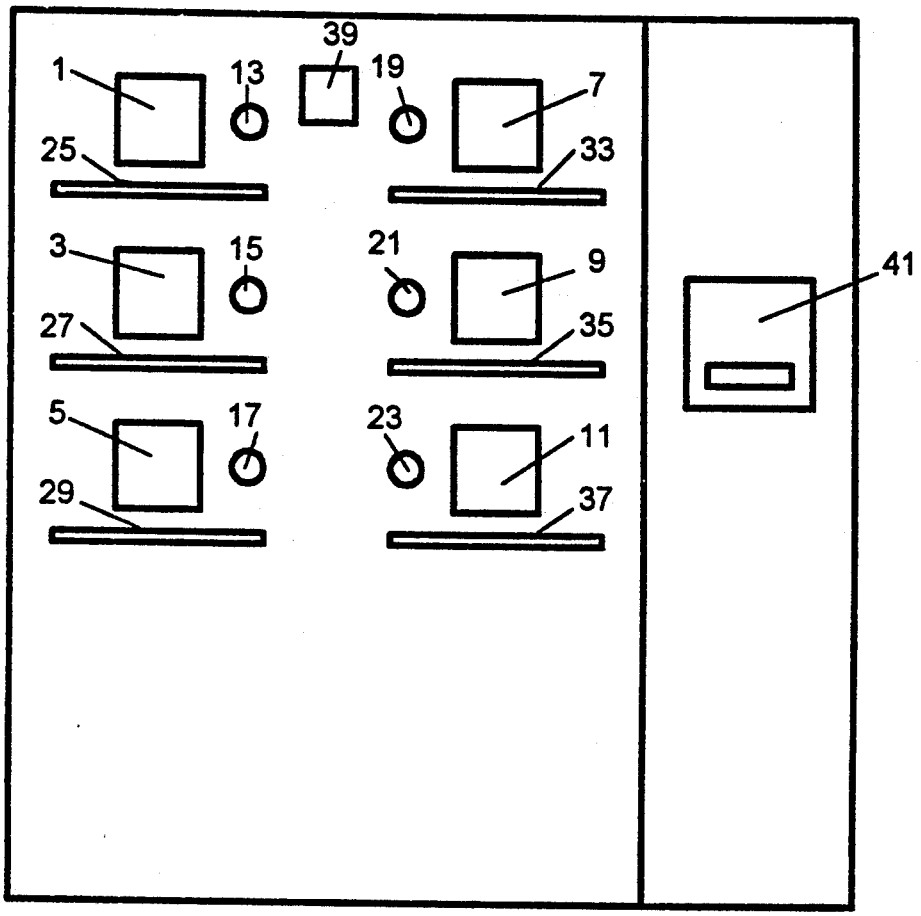
FIG. 1 shows a six game example lottery machine of the present invention.

Referring to FIG. 1 a conceptual six game lottery machine of the present invention is shown (although a machine having any number of chance games is contemplated by the present invention). The actual games to be played (i.e. sample tickets) are displayed in display windows 1, 3, 5, 7, 9 and 11. The user has the option of selecting a specific chance game by actuating a play button 13, 15, 17, 19, 21 and 23 corresponding to the game to be played. Thereafter, the ticket is dispensed from a dispensing port 25, 27, 29, 33, 35 and 37 corresponding to the game to be played. If the user desires a random selection of the game to be played the user depresses a separate button 39 which invokes the random game selection means of the present invention, instructing a processing means to select a chance game at random. The lottery machine is also equipped with a payment means 41 where user can insert coin or paper money to provide a credit to play the desired game.

Figure 2:
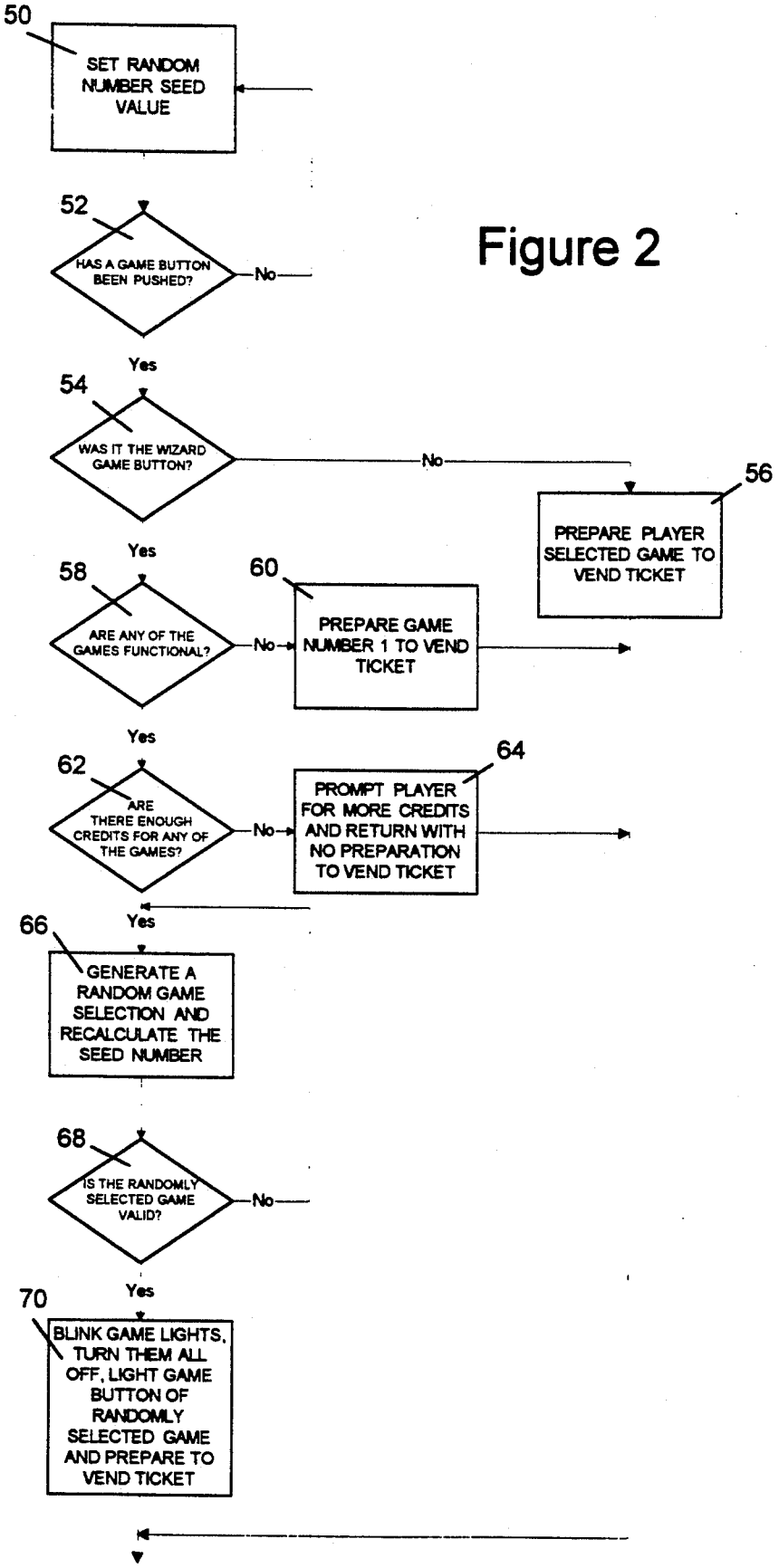
FIG. 2 shows a flow diagram of the random game selection algorithm.

Referring to FIG. 2 the random game selection algorithm is described. When the lottery machine is first energized a random number seed value is established 50. That random number seed value is between 1 and "n" with "n" being the total number of games on the lottery machine. The seed value is the input to the pseudorandom sequence generating means which is a part of the processing means. The seed value is a number presented to the processing means as a sequence of binary numbers. The length and/or value of this sequence may vary depending on the number of chance games available for random selection.

In the preferred embodiment, the processing means comprises a microprocessor, along with any supporting electronic circuitry. The preferred microprocessor is a Sygnetics 80C652 or equivalent, although any microprocessor may be advantageously used as part of the present invention. The pseudorandom sequence generator may be resident in the microprocessor itself, for example as part of an on-chip algorithm, or it may be part of the supporting circuitry. For example, a well known pseudorandom sequence generator comprises a series of shift registers, the outputs of some of which are inputs to XOR gates. Such circuitry may be controlled by the microprocessor to generate a pseudorandom sequence or number under the direction of the microprocessor, as part of the system controller function performed by the processing means. In the present invention the microprocessor involved can be programmed to accommodate lottery machines having any number of chance games and thus is adapted for use in a variety of different lottery machines. In the preferred embodiment the microprocessor of the present invention operates on a polling architecture whereby it continually inquires whether a game button has been pushed by a player. If no game button has been pushed the random number seed value remains the same and the system waits for a player to actuate a game button. The random selection feature of the present invention may also be used with systems designed around any other type of architecture, such as an interrupt type system.

When a game button is actuated the system determines whether the button actuated was the random game selection button 54. If the button activated was not the random game selection button the system interprets the actuation signal to be that a player has chosen a specific game. Thereafter the system prepares to vend a selected game ticket to the user 56.

If the random game selection button was actuated the system inquires as to which of the games are functional 58. If only a single game is functional the system prepares that game to vend a lottery ticket 60. If more than one game is functional the system next inquires if the user has enough credits for any of the games. 62. This is necessary since different chance games may have different prices and it is necessary for the user to establish an appropriate level of credit with the lottery vending machine in order to purchase a particular ticket. If there are insufficient credits to play certain of the games the system prompts the player to provide more money to play the game. Thereafter the system returns to a preparation to play further games mode without vending a lottery ticket 64.

If there are sufficient credits to play the chance games the system generates a random game selection and recalculates the seed value 66. If the randomly selected game is not valid or functional the system returns to the random number/game selection 66 step and a new number is calculated. If the game selected is valid the system blinks the various game lights on and off in a sequence, eventually lighting only the game button that has been randomly selected 70 and the system prepares to vend the ticket. Thus, when a player chooses the random game selection option, he sees the game lights illuminate in an irregular sequence which finally stops on the game randomly chosen for him by the system.

Thereafter, all vending of lottery tickets occurs in the normal fashion through the ticket dispenser.

In this fashion a user that desires an additional chance aspect of playing lottery games can invoke a random game selection bid by adding additional uncertainty to the purchase of lottery tickets.

Figure 3:
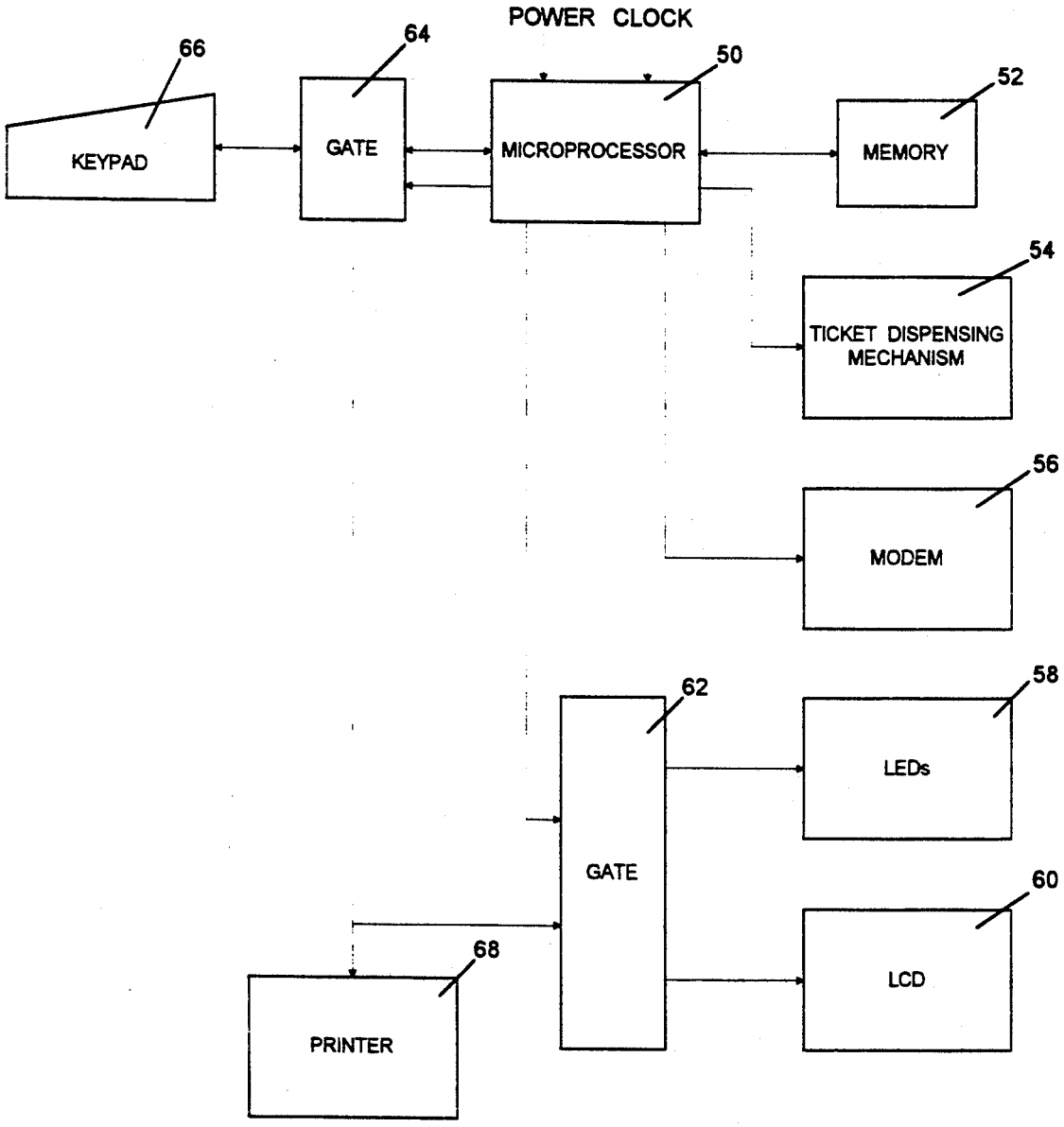
FIG. 3 shows a diagram of a portion of the Lottery Ticket Machine.

Referring to FIG. 3 the relevant circuitry of the preferred embodiment of the present invention is shown. Microprocessor 50 calculates a random number based upon a pseudorandom number generation program stored in memory 52. The microprocessor generates its random number based upon a signal received from the various keypads 66, game buttons, or other input means operating through gate 64 to provide the microprocessor with the signal that a keypad has been actuated. This signal represents user selection data. The keypad can be the actuation key for any one of a number of games or the actuation key that provides the signal for random number generation. Once the random number is selected microprocessor 50 provides a series of instructions through gate 62 to LEDs 58 which sequentially light up indicia of the various games to be played giving the impression of a random selection via sequentially blinking game lights. After the appropriate sequence of game indicia lighting takes place the microprocessor instructs the ticket dispensing mechanism 54 to dispense the appropriate ticket which corresponds to the random number selected by the microprocessor.

It should be noted that the microprocessor also controls a printer 68 through gate 64 which provides for a printed output of transactions on a periodic basis to the merchant in whose establishment the lottery ticket machine is located.

SUMMARY

A random game selection lottery purchase machine has been described. While a particular algorithm for the generation of a random number and subsequent selection of a game on a random basis has been shown other mechanisms for and methods for random selection of games will be apparent to those skilled in the art without departing from the spirit and scope of the invention as disclosed.

I claim:

1. A lottery system having a plurality of chance games available to a player, comprising:

a) processing means comprising a pseudorandom sequence generating means and a controller;

b) input means connected to the processing means for accepting player selection data and for providing player selection data to the processing means;

c) visual game indicia connected to the processing means; and d) a ticket dispenser connected to the processing means for dispensing lottery tickets;

e) the input means including means for enabling the player to select a particular chance game to play from among the plurality of available chance games;

f) the input means further including means for enabling the player to instruct the lottery system to select at random a chance game to play from among the plurality of available chance games; and g) the lottery system including means for selecting a chance game at random and means for dispensing a corresponding ticket when so instructed by the player.

2. The lottery system of claim 1, wherein the input means is a keypad.

3. The lottery system of claim 1, wherein the input means is a plurality of game buttons.

4. The lottery system of claim 1, wherein the means for selecting the chance game at random includes the pseudorandom generating means and the controller.

5. The lottery system of claim 1, wherein the lottery system includes means for lighting the visual indicia in a sequence when the player instructs the lottery system to select a game at random.

6. The lottery system of claim 1, wherein the processing means comprises a microprocessor.

7. The lottery system of claim 6, wherein the microprocessor is adapted to work with different lottery systems having different numbers of chance games available to players.

8. The lottery system of claim 1, wherein the processing means includes means for polling the input means for selections and instructions from the player.

9. The lottery system of claim 1, wherein the visual indicia are lights.

10. The lottery system of claim 1, wherein the input means are also the visual indicia.

11. The lottery system of claim 1, further comprising a printing means connected to the processing means for printing records of system use.

12. A processor-based method for the random selection and dispensation of lottery games, comprising the following steps in the order listed:

a) accepting a signal from an input means;
b) interpreting the signal as an instruction to randomly select a lottery game through the use of a processing means;
c) providing a seed value signal from a memory means to a pseudorandom sequence generating means;
d) generating a pseudorandom sequence signal based on the seed value signal;
e) interpreting the pseudorandom sequence signal as a particular lottery game selection signal;
f) providing the lottery game selection signal to a ticket dispensing means; and
g) dispensing a lottery ticket to a player based on the lottery game selection signal.

13. The processor-based method for the random selection and dispensation of lottery games of claim 12, further comprising the step of lighting a plurality of visual indicia in a sequence prior to dispensing the lottery ticket.

14. A lottery system having a plurality of chance games available to a player, comprising:

a) processing means comprising a pseudorandom sequence generating means and a controller;
b) input means connected to the processing means for accepting player selection data and for providing the player selection data to the processing means;
c) visual game indicia connected to the processing means; and
d) a ticket dispenser connected to the processing means for dispensing lottery tickets;
e) the input means including means for enabling the player to select a particular chance game to play from among the plurality of available games;
f) the input means further including means for enabling the player to instruct the lottery system to select at random a chance game to play from among the plurality of available chance games;
g) the lottery system including means for selecting a chance game at random and means for dispensing a corresponding ticket when so instructed by the player;
h) the pseudorandom sequence generating means including means for selecting the chance game at random under the direction of the controller; and
i) the lottery system including means for lighting the visual indicia in a sequence when the player instructs the lottery system to select a game at random.

15. The lottery system of claim 14, wherein the input means is a keypad.

16. The lottery system of claim 14, wherein the processing means comprises a microprocessor that is programmed to work with different lottery systems having different numbers of chance games available to players.

17. The lottery system of claim 14, wherein the processing means includes means for polling the input means for selections and instructions from the player.

18. The lottery system of claim 14, wherein the visual indicia are lights.

19. The lottery system of claim 14, wherein the input means are also the visual indicia.

20. The lottery system of claim 14, further comprising a printing means connected to the processing means for printing records of system use.

* * * * *